US005487713A

United States Patent [19]

Butler

[11] Patent Number: 5,487,713

[45] **Date of Patent: * Jan. 30, 1996**

[54] AQUATIC EXERCISE AND REHABILITATION DEVICE

[76] Inventor: Brian R. Butler, 2727 Hillview Dr., Broomall, Pa. 19008

[ * ] Notice: The portion of the term of this patent subsequent to May 31, 2011, has been disclaimed.

[21] Appl. No.: 236,559

[22] Filed: May 2, 1994

Related U.S. Application Data

[63] Continuation-in-part of Ser. No. 105,758, Aug. 12, 1993, Pat. No. 5,316,532.

[51] Int. Cl.[6] ..... A63B 21/008; A63B 22/06

[52] U.S. Cl. ..... 482/111; 482/57

[58] Field of Search ..... 482/111, 57, 51–54, 482/112, 58; 4/563.1; 119/700, 702

[56] References Cited

U.S. PATENT DOCUMENTS

| | | | |
|---|---|---|---|
| 4,162,788 | 7/1979 | Turnier . | |
| 4,183,106 | 1/1980 | Grimes et al. | 4/563.1 |
| 4,188,030 | 2/1980 | Hooper . | |
| 4,241,688 | 12/1980 | Mansolill . | |
| 4,249,725 | 2/1981 | Mattox . | |
| 4,509,742 | 4/1985 | Cones . | |
| 4,712,788 | 12/1987 | Gaudreau | 4/563.1 |
| 4,757,988 | 7/1988 | Szymski . | |
| 4,759,544 | 7/1988 | Diaz . | |
| 4,776,581 | 10/1988 | Shepherdson . | |
| 4,784,385 | 11/1988 | D'Angelo . | |
| 5,050,863 | 9/1991 | Yacoboski . | |
| 5,116,295 | 5/1992 | Dunn . | |
| 5,123,641 | 6/1992 | Abboudi . | |
| 5,135,448 | 8/1992 | Dunn . | |
| 5,218,727 | 6/1993 | Krumbeck | 4/563.1 |

*Primary Examiner*—Stephen R. Crow
*Attorney, Agent, or Firm*—Connolly & Hutz

[57] ABSTRACT

An aquatic exercise and rehabilitation apparatus comprised of a fluid filled anti-splash treatment vessel and adjustable exercise cycle component having a unique pedal and handlebar assembly adaptable for use by individuals with unilaterally or bilaterally diminished mobility or range of motion of the upper or lower extremities, as well as by amputees and other musculoskeletal and neurologically challenged individuals. The pedal assembly is comprised of a series of concentrically interconnected discs each adapted with a plurality of incrementaly spaced receptors along their radii to removably receive therein means for securing the user's lower extremities. Depending on the receptors selected and their respective distance from the disc's center, each lower extremity will be permitted to independently achieve a minimal to maximal path of travel. Moreover, the pedal assembly may be alternately driven by application of force to the pedals themselves, as applied by the user's legs, or by oscillation of the handlebars which communicate with the pedal assembly, providing benefit to user's with lower body impediments to movement. A water powered piston assembly is attached to the cycle component to accomplish safe and effortless movement of the user into and out of the treatment vessel. This drive system accomplishes a smooth and dependable ride that is user controlled by means of local hand controls or remotely by an assistant or therapist.

12 Claims, 4 Drawing Sheets

90
86
88
84
20
58
82
42
48
80
60
40
72
76
10
78
64
94
62
92
96
98
102
100

AQUATIC EXERCISE AND REHABILITATION DEVICE

CROSS-REFERENCE TO RELATED APPLICATION

This application is a continuation-in-part of Ser. No. 08/105,758, filed Aug. 12, 1993, now U.S. Pat. No. 5,316, 532.

BACKGROUND OF THE INVENTION

The subject invention relates to an aquatic exercise and rehabilitation apparatus and, more particularly, to an apparatus comprised of a fluid filled vessel and submersible exercise cycle for use by individuals suffering from a wide range of musculoskeletal and neurological pathologies.

The use of exercise devices disposed within a body of water or other fluid for reducing stresses on the user's body has heretofore been described in U.S. Pat. Nos. 3,485,213 and 4,332,217. These references teach the use of a treadmill submerged in a liquid filled container for exercising animals. Additionally, U.S. Pat. Nos. 4,576,376, 4,172,788 and 4,776, 581 teach treadmill and/or cycle type underwater exercise apparatus for use by humans. While the above-identified patents are of interest, each fail to provide a safe and effective means of accessibility by and treatment for seriously incapacitated users such as, for example, paraplegics, amputees or other non-ambulatory individuals.

With regard to accessibility, prior art hydrotherapy devices frequently require a difficult transition from a wheel chair into a treatment tank or pool and then into the exercise apparatus itself. Such a process can be frustrating to both a weak or immobile patient as well as to the therapist assisting in the move. Submerged exercise equipment is frequently heavy and difficult to manipulate under water. Changing seat height to suit each individuals needs, for instance, requires either that the patient be capable to perform the task or that the therapist enter the water him or herself to make the adjustment. The same transition in reverse must be accomplished upon completion of the therapy session when the treated individual is more likely to be in a fatigued condition, making exiting the pool even more problematic. Safety concerns are also paramount with prior art aquatic rehabilitation equipment because of the great potential for slipping on wet floors surrounding the pool, particularly when a great deal of assistance is required for a treated individual to re-enter a wheel chair or portable stretcher where loss of balance or grip are frequently encountered.

With regard to the effectiveness of the submerged exercise or rehabilitation equipment of the prior art itself, all too often they are unable to accommodate the diverse needs of individuals with various limitations. Certainly, the employment of a treadmill apparatus is impracticable for those having seriously limited mobility of one or both lower extremities. Many individuals are incapable of maintaining a standing posture, even in water and with the support of handrails, for periods of time sufficient to achieve cardiovascular benefit. even those prior art apparatus employing a cycle are ill-suited for leg amputees or those having diminished control over leg movement such as those afflicted with multiple sclerosis. Individuals experiencing a decreased range of motion in only one leg, as another example, will find it difficult, if not impossible, to complete an entire rotation cycle of the pedal assembly. Prior art cycle devices are also incapable of compensating for individuals with restricted knee or hip movement such as may be experienced by post-surgical patients.

Still another limitation of prior art hydro-rehabilitation equipment relates to the difficulty of removing the exercise component from the underwater environment for maintenance and repair. Working on such equipment within the confines of a drained tank can be awkward, but perhaps preferable to manually lifting the device over the walls of the enclosure with the attendant risk of damaging one component, the other, or both.

The subject invention completely obviates all of the shortcomings associated with the above mentioned patents and other prior art apparatus by providing an easily accessible, safe and effective means of treating individuals with ab road range of medical conditions. Almost anyone with musculoskeletal indications and many with neurological involvements will gain exceptional benefits from therapy in the subject apparatus which enables everyone to securely enter and exit the treatment vessel. It allows debilitated patients to rapidly gain strength and aerobic conditioning in a stress free, warm water environment, the therapeutic qualities of which are well recognized by the medical community.

The subject invention is designed to accommodate and offer therapeutic value to individuals with upper and lower extremity stress and trauma fractures (conditioning & strengthening under non-weight being conditions), various ligament strains and tears, stroke rehabilitation, post polio syndrome, severe chronic arthritis, lyme disease symptoms, multiple sclerosis and other debilitating conditions. Also, patients who have suffered severely debilitating illnesses such as cancer may regain strength through exercising in the buoyant, warm, resistive atmosphere created by the subject invention.

SUMMARY OF THE INVENTION

More specifically, the subject invention relates to an aquatic exercise and rehabilitation apparatus comprised of a fluid filled anti-splash treatment vessel and adjustable exercise cycle with a unique pedal and handlebar assemble adaptable for use by individuals with unilaterally or bilaterally diminished mobility or range of motion of the upper or lower extremities, as well as by amputees and other musculoskeletal and neurologically challenged individuals. the pedal assembly is comprised of a series of concentrically interconnected discs each adapted with a plurality of incrementaly spaced receptors along their radii to removably receive therein means for securing the user's lower extremities. Depending on the receptors selected and their respective distance from the disc's center, each lower extremity will be permitted to independently achieve a minimal to maximal path of travel. Moreover, the pedal assembly may be alternately driven by application of force to the pedals themselves, as applied by the user's legs, or by oscillation of the handlebars, which communicate with the pedal assembly, by user's capable of upper body movement only.

A water powered piston assembly is attached to the cycle component to accomplish safe and effortless movement of the user into and out of the treatment vessel. This drive system accomplishes a smooth and dependable ride that is user controlled by means of local hand controls or remotely by an assistant or therapist. Once the user is fitted to the cycle in accordance with is or her particular needs, the piston assembly is activated to lift the user over the treatment vessel and into the water in a seated orientation to the desired depth, usually with just the neck and head above water. Displaced water is released into a drain as the cycle and user are submerged. Users are not required to be able to lift their legs as they pass over the side of the pool. Minimal resistance to user movement is provided by the surrounding water and may be increased by conventional means such as by a plurality of paddles situate in radial orientation about each disc's circumference. Accordingly, the subject invention provides a means for exercising and improving muscle groups of the arms, legs, upper and lower torso to achieve effective therapeutic treatment in a non-weight bearing environment.

It is, therefore, a primary object of the subject invention provide an aquatic exercise and rehabilitation apparatus for individuals suffering from a broad range of musculoskeletal and neurological indications.

More particularly, it is a primary object of the subject invention to provide an aquatic exercise and rehabilitation apparatus for individuals having little to no control over, or a restricted range of motion for, one or both of the upper or lower extremities.

It is also a primary object of the subject invention to provide an aquatic exercise and rehabilitation apparatus adaptable for use by leg amputees.

It is another primary object of the present invention to provide an aquatic exercise and rehabilitation apparatus capable of safely transporting the user into and out of the treatment vessel by means of a hydraulic piston assembly operated by the user or attendant.

Still another object of the subject invention is to provide an aquatic exercise and rehabilitation apparatus which may be maintained, repaired and, most importantly, adjusted to fit the needs of individual users outside of the aquatic environment.

Other objects and advantages of the present invention will be apparent upon reference to the accompanying description when taken in conjunction with the following drawings.

THE DRAWINGS

DETAILED DESCRIPTION

Figure 2:
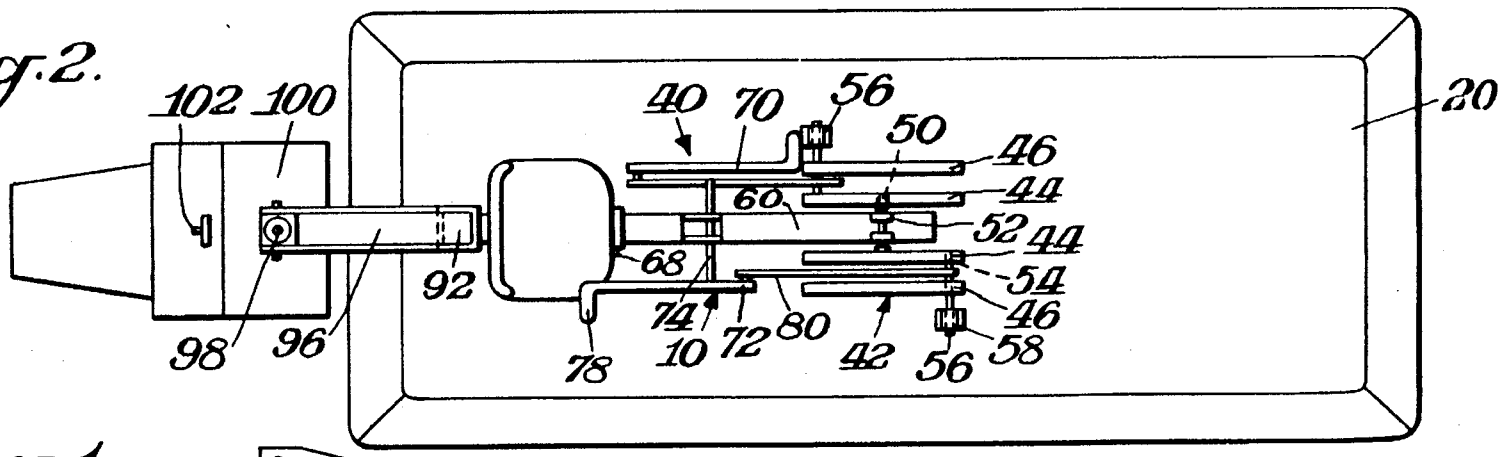
FIG. 2 is a top view of the apparatus of FIG. 1.
Figure 1:
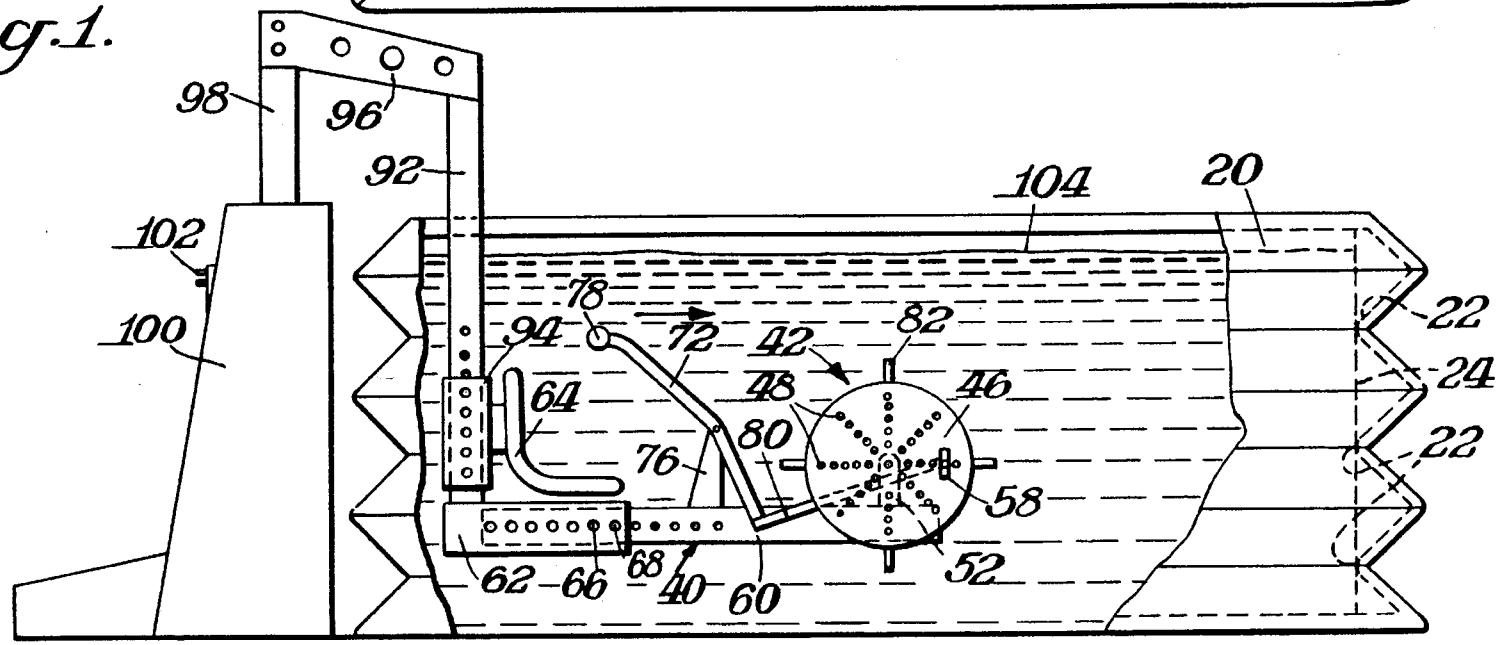
FIGS. 1 is a right side elevational view of the subject aquatic exercise and rehabilitation apparatus, portions of which are depicted in phantom line or broken view such that abetter appreciation of the cycle component in its submerged position may be accomplished.
Figure 7:
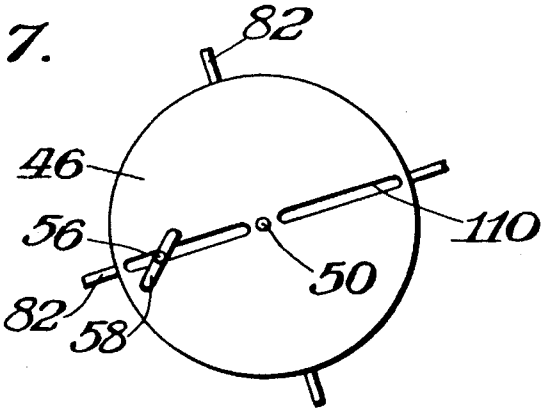
FIG. 7 is a side view of the disc component of the subject invention having radially extending slot receptors.

Reference is now made to FIGS. 1 and 2 wherein the subject aquatic exercise and rehabilitation apparatus is depicted in side elevational and top views, respectively, wherein similar elements have been assigned common reference numerals. The subject invention is comprised of a fluid filled anti-splash treatment vessel 20 (see FIG. 7 and accompanying text, below), an adjustable exercise cycle component designed generally by reference numeral 40, and an automated lift assembly 100.

Cycle 40 is comprised, in part, of a unique pedal assembly 42 in communication with an oscillatable handlebar assembly 10, together adaptable for use by individuals with unilaterally or bilaterally diminished mobility or range of motion of the upper or lower extremities, as well as by amputees and other musculoskeletal and neurologically challenged individuals. Pedal assembly 42 is comprised of two inner and two outer concentrically interconnected discs 44 and 46, respectively, each adapted with a plurality of incrementaly spaced transverse cylindrical receptors 48 along their radii. Inner discs 44 are rotatably mounted to axle 50 which in turn is received by laterally spaced forks 52 in a conventional manner. Each outer disc 46 is connected by a cylindrical bridge 54 to an inner disc 44 in parallel relationship such that rotation of either disc will effect rotation of the other. Each end of bridge 54 is partially disposed within receptors 48 to accomplish the connection. Bridge 54 and receptors 48 may be reciprocally threaded or otherwise constructed to achieve a secure connection. Additionally, a lockable hub mechanism (not shown) may be adapted to either end of axle 50 such that rotation of any disc will effect rotation of the others. Receptors 48 of outer discs 46 further serve to receive crank arms 56 which extend laterally from the discs' outer surface a distance sufficient to accommodate rotatable mounting of conventional foot pedals 58.

In another embodiment of the inner and outer discs 44 and 46, at least one radially extending transverse slot 110 (FIG. 7) may be substituted for the plurality of incrementaly spaced cylindrical receptors 48. Bridges 54 and crank arms 56 may be slidably received in these slots to achieve infinite adjustability along their lengths. It should be appreciated, therefore, that adjustment may be accomplished without the necessity of removing either bridges 54 or crank arms 56 for reinsertion at a different cylindrical receptor location. Rather, releasable locking means may be employed to secure these components at a desired distance from the discs; center by simply disengaging the locking mechanism and sliding either bridge 54 or crank arm 56 forward or reward along the slot to the desired new location.

Cycle 40 is further comprised of a frame having a hollow, longitudinally extending box beam 560 which terminates at one end with vertically oriented and fixedly mounted forks 52 which support pedal assembly 42 as described above. The opposite end of extension beam 60 is slidably received within sleeve member 62, situate below seat 64. Extension beam 60 and sleeve member 62 are adapted with incrementaly spaced pin holes 66 through which pin 68 may be received to secure the bema in place. It can thus be appreciated that pedal assembly 42 may be adjusted at various distances from seat 64 to accommodate individuals with a broad range of leg lengths.

Another feature of the subject invention is that the handle bars are pivotally mounted to the frame and are drivably connected to pedal assembly 42 so that rotation of discs 46 can be achieved either through leg movement or arm movement, or both. Handle bar assembly 109 is comprised of two separate handle bars, 70 and 72. Each handle bar 70 and 72 operates as an elongate lever pivotally connected to transverse rod member 74 which in turn is mounted to extension beam 60, via upright 76, in a location intermediate pedal assembly 42 and seat 64. Handlebars 70 and 72 are arranged so as to extend generally upright and may be bent to extend rearwardly for convenient engagement by the user. Laterally projecting hand grips 78 may also be provided for user comfort.

Communication between handlebar assembly 10 and pedal assembly 42 is accomplished by means of a pair of drive shafts 80, each pivotally connected at one end to a handle bar 70 and 72 at a point below transverse rod member 74 and disposed between inner and outer discs 44 and 46 at the other. Drive shafts 80 are rotatably mounted to bridges 54 which in turn may be mounted to discs 44 and 46 at various radial distances from axle 50 to achieve the desired length of handle bar travel. This feature of the subject invention may best be understood upon reference to FIGS. 3A and 3B wherein similar mechanism is employed to adjust the path of travel of crank arms 56.

Figure 3A:
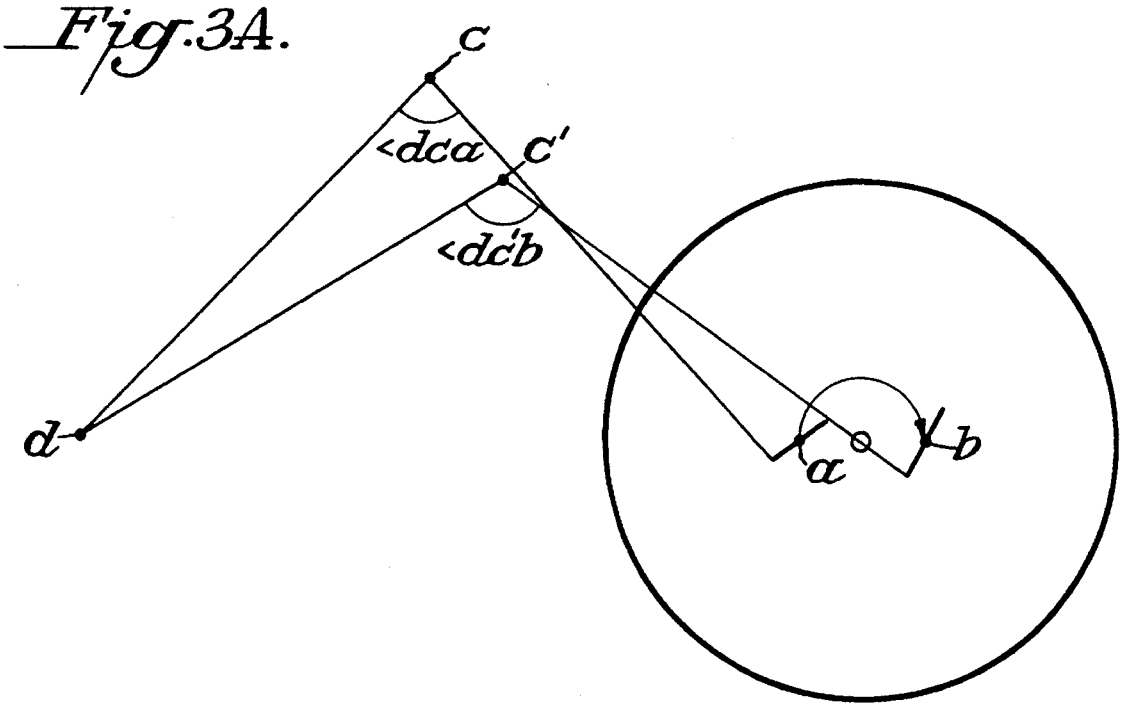
FIG. 3A is a schematic representation of the path of travel experienced by a user's lower extremity when the subject pedal assembly is configured to permit a full range of motion during exercise.
Figure 3B:
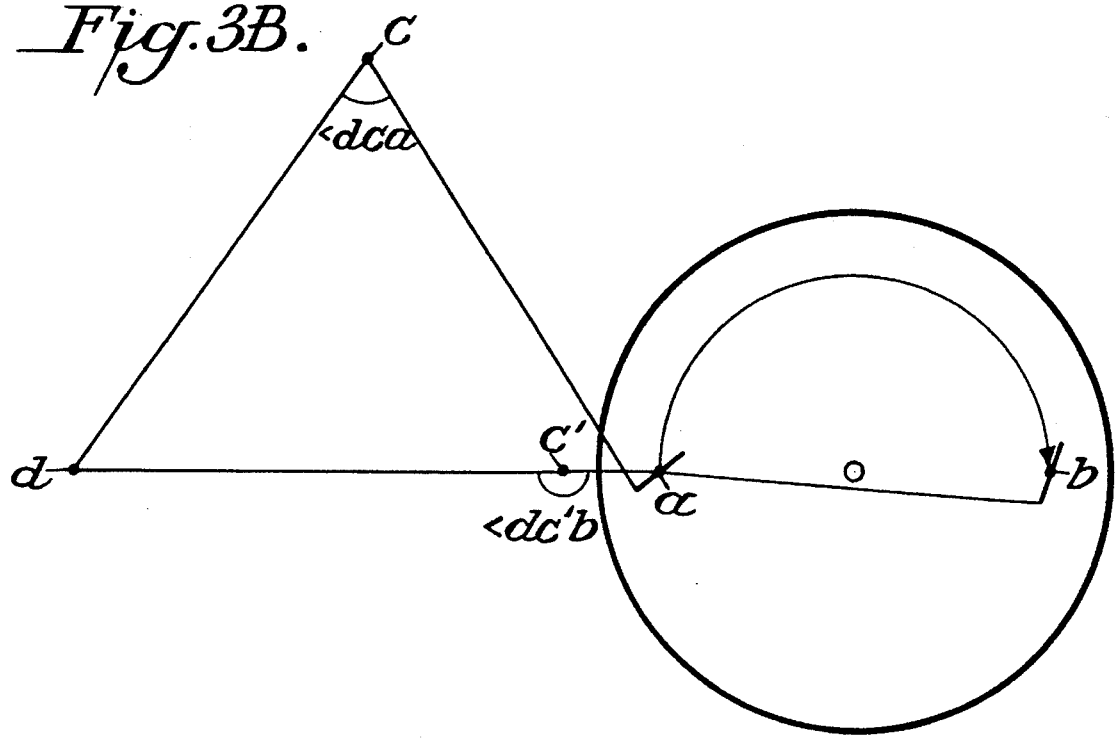
FIG. 3B is a schematic representation of the path of travel experienced by a user's lower extremity when the subject pedal assembly is configured to accommodate individuals having a more limited range of motion.

A comparison of FIGS. 3A and 3B reveals that the degree of travel experienced by the user's lower extremity is directly related to the receptor 48 selected for crank arm 56's insertion. Note that when a receptor 48, situation more proximate to the center of disc 46, is selected (FIG. 3A), the distance traversed 82 by the user's limb 84 will be relatively short when compared to the distance traversed 82 in FIG. 3B when a receptor 48 located further from the center of disc 46 is selected. Similarly, when slotted receptors are employed, rather than cylindrical receptors 48, placement of crank arm 56 in that portion of the slot nearest the center of disc 46 will effect a minimal path of travel by the user's limb. It should further be appreciated that the range of motion experienced by the user's knee and hip joints, designated c and d respectively, as the limb travels from point a to point b, can be minimized or maximized depending on the receptor 48 selected. This fact can be appreciated by a comparison of the angles dca and dc'b of FIG. 3A with those same angles of FIG. 3B. Note that the range of motion dc'b minus dca is significantly less in FIG. 3A than in FIG. 3B. A similar occurrence is experienced by the hip, elbow and shoulder joints.

A few additional comments are in order regarding the subject inventions adjustability. The mechanism described above may be performed independently for each crank arm 56 and bridge 54 of pedal assembly 42 to accommodate individuals having a different range of motion for each leg or arm. Each lower extremity, therefore, is permitted to independently achieve a minimal to maximal path of travel. Moreover, the pedal assembly may be alternately driven by application of force to the crank arm 56, as applied by the user's legs, or by oscillation of the handlebars 70 and 72, as applied by the user's arms. Preferably, as shown in FIGS. 1 and 2, crank arms 56 will be arranged 180° out of phase as will bridges 54 in the same plane so as to achieve a natural balance between upper and lower body movement sin a manner similar to walking. That is, when the right leg of the user is extended outwards, the left arm and should are also moving forwards. In another configuration, however, cycle 40 may simulate a rowing apparatus by arranging bridges 54 in phase with each other and crank arms 56 opposite disc 46 center along the same diameter. The hub of axle 50 may then be locked and the user instructed to push and pull handle bars 70 and 72 in a rowing fashion while the legs follow. Here again, the user may alternatively select to perform this task by movement of the legs or by both the arms and legs, depending on the particular limitations involved.

Figures 4, 5, 6A:
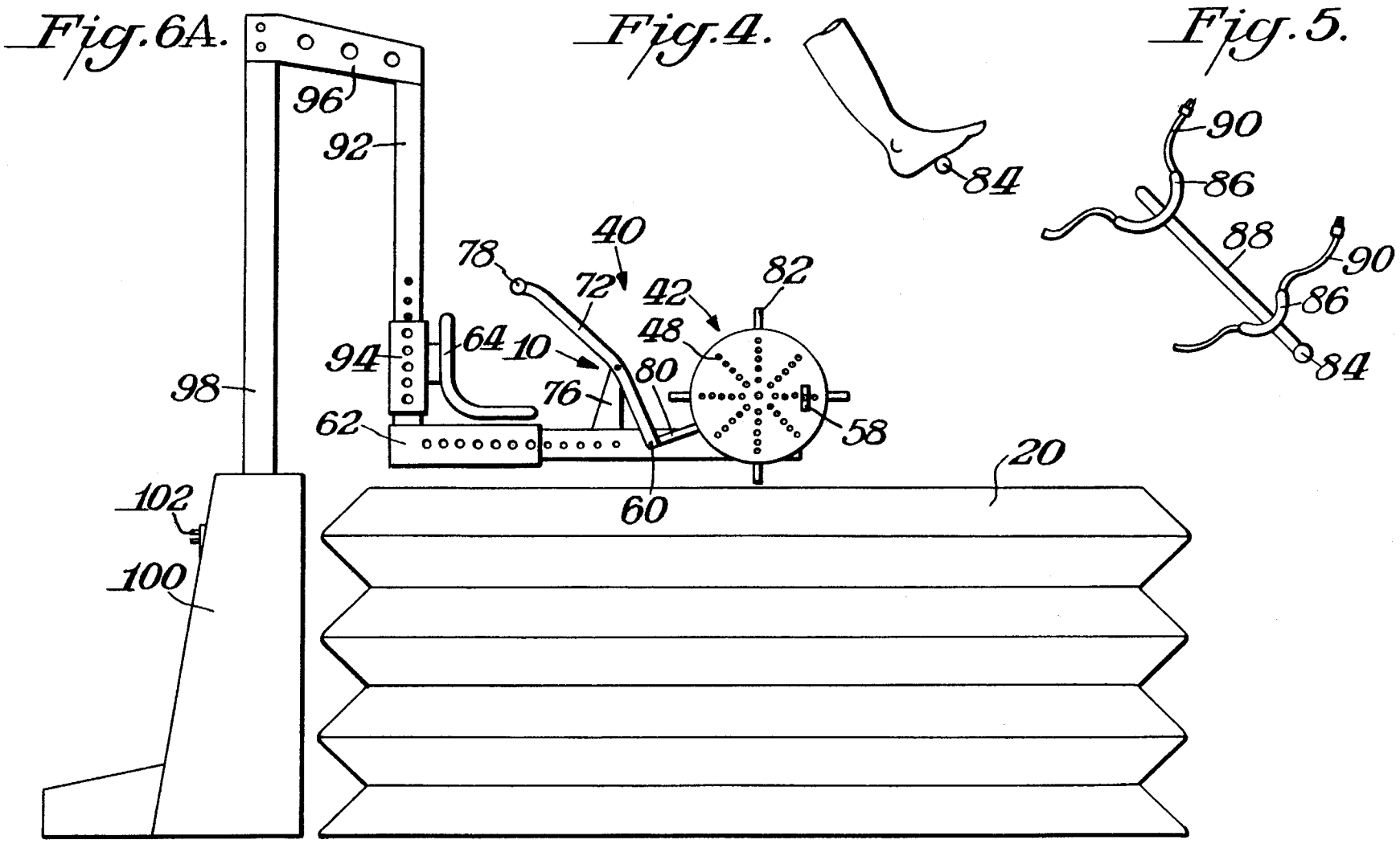
FIG. 4 depicts a prosthetic adaptor for use by amputees.
FIG. 5 depicts a limb brace adaptor for use by individuals having diminished motor control of the lower extremity.
FIG. 6A depicts the apparatus of FIG. 1 with the cycle component in its elevated position.

Reference is now made to FIGS. 4 and 5 wherein a prosthetic adaptor for use by amputees and a limb brace adaptor for sue by individuals having diminished motor control of the lower extremity are depicted. With regard to the former, this adaptor can be configured to varying lengths to accommodate individuals having amputations sites above or below the knee joint. A ring 84 fixedly attached under the arch of the prosthesis serves to secure the limb to the pedal assembly by sliding onto crank arm 56. Other methods and device may also be employed to accomplish this purpose. The limb brace adaptor pictured in FIG. 5 is comprised of two U-shaped cradles 86 fixedly mounted to a rigid shaft 88 which terminates in a ring 84 identical to that described above. Because individuals having unilateral or bilater control deficits over a limb would unlikely be capable of maintaining their feet on conventional pedals and, consequentially, be unable to reap the benefits offered by the subject invention, the limb brace adaptor was conceived to act as a harness to secure the limb to the pedal assembly 42. Once the user's lower leg is secured to the apparatus by straps 90, it may be moved through the desired range of motion by activation of either the handle bar assembly 10 or pedal assembly 42 with the opposite leg if functional.

It should now be apparat that a user of the subject apparatus can proportion the ration of effort contributed by the arms and legs dependent on the degree of functionally found in either to achieve improved mobility and exercise of several muscle groups as well as an overall cardiovascular workout. Progress in extending the user's range of motion maybe measured by recording which receptor 48 is selected on each day of treatment. Receptors 48 may be numbered for added convenience. It should further be understood that the cycle component 40 of the subject invention, together with the adapters discussed above, amy also be used alone or in a non-aquatic environment with minor alterations.

Figure 6B:
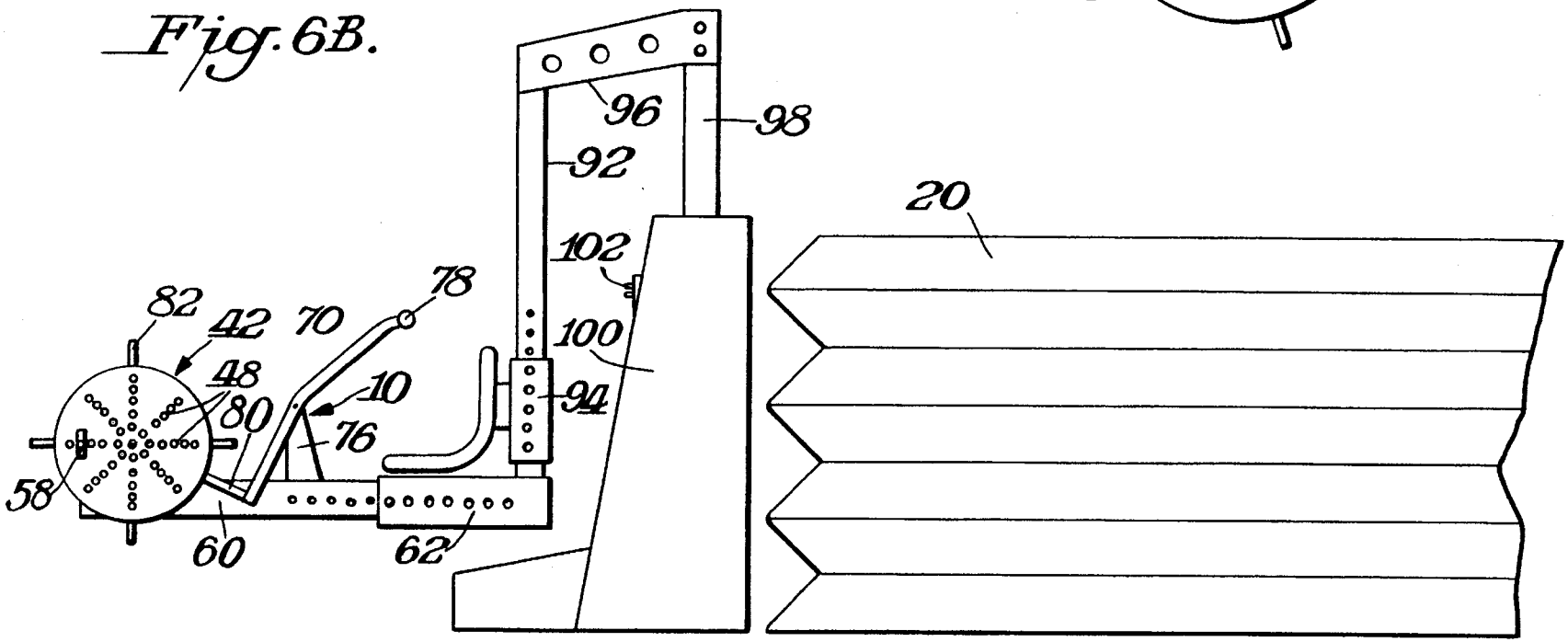
FIG. 6B depicts the apparatus of FIG. 1 with the cycle component rotated behind the treatment vessel in its lowered position.

The two remaining components of the subject aquatic exercise and rehabilitation apparatus are the anti-splash treatment vessel 20 and lift assembly 100. A vertical support column 92 is fixedly attached to sleeve member 62 by weld or other means. A second slidable sleeve member 94 is mounted to column 92 and supports chair 64 which may be adjusted vertically as needed. Support column 92 is connected to hydraulically operated lift column 98 by a pair of cross-supports 96. Referring to FIGS. 6A and 6B the operation of lift assembly 100 is illustrated.

In an alternative practice of the invention, the lift assembly could move the user to and from the vessel in a back and forth movement rather than a pivotal or rotational movement.

When outside treatment vessel 20, lift assembly 100 is parked in a down position (FIG. 6B) allowing easy access to and from cycle component 40. It is in this position that the user may be safely fitted to the cycle apparatus making any adjustments necessary for a productive session. For safety purposes the user would be strapped to the seat by a seat belt. This parked position is also ideal for maintaining and repairing the cycle component in an unrestricted environment. The therapist then activates the hydraulic system via control panel 102 raising the user to a horizontal position above the clearance point of the treatment vessel 20. Other controls are activated to then rotate the user in a clockwise or counterclockwise direction until over the center of treatment vessel 20 (FIG. 6A). Cycle 40 and the user are then slowly lowered with a smooth descent into the vessel until submerged in the water with the neck and head of the user remaining above water line 104. The user then commences the appropriate protocol and is lifted from the treatment vessel when the session is complete. Controls 102 may alternately be fitted to chair 64 for localized operation by the user.

Treatment vessel 20 (FIG. 7) is designed with anti-splash sidewalls having a relatively accordion-like configuration. A series of undulating horizontal mantels 22 surround the interior of the vessel and serve to redirect vertically flowing liquid into the center of the enclosure thereby reducing turbulence and splashing which might disturb the submerged user. A screen 24 lines the entire interior perimeter of the vessel to further quell turbulence by slowing liquid flow before contacting the side walls. Vessel 20 may also be equipped with conventional heaters, air blowers, pumps, filters, lights and other peripherals (not shown) as desired.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

The invention also provide for a mounted seat inside the vessel that can be stationary or removable for an assistant to provide additional help while patient is in the tank.

What is claimed is:

1. An aquatic exercise and rehabilitation apparatus, comprising an exercise cycle having a frame, a seat, a pedal assembly, a pair of drive shafts and an oscillatable handlebar assembly, (a) said pedal assembly having two inner and two outer concentrically interconnected discs;

(b) said inner discs being rotatably mounted to an axle which in turn is fixedly mounted to said frame, and said inner discs each being connected to one of said outer discs by bridge means such that rotation of either disc will effect rotation of the other;

(c) said outer discs having crank arms with foot pedals attached thereto; and (d) said handlebar assembly having two levers pivotally connected to said frame; said levers each being pivotally connected to said drive shafts which are in turn pivotally connected to said bridge means such that operation of either said handlebar assembly or said pedal assembly will effect movement of the other; and (e) said seat being mounted to a lift assembly for selectively moving a user to a first position outside a treatment vessel and a second position within the treatment vessel whereby said exercise cycle may be adapted for use in the treatment vessel by individuals with unilaterally or bilaterally diminished mobility or range of motion the upper or lower extremities.

2. The aquatic exercise and rehabilitation apparatus of claim 1, wherein (a) said lift assembly having a vertical support column attached to said frame of said exercise cycle, a hydraulically operated lift column, controls for the operation of said lift column, and a pair of cross supports each connecting said support column with said lift column; and (b) whereby said lift assembly may be activated by said controls to effect vertical and horizontal movement of said exercise cycle into and out of a treatment vessel.

3. The aquatic exercise and rehabilitation apparatus of claim 1, further comprising an anti-splash treatment vessel of relatively accordion-like configuration having undulating horizontal mantels which serve to redirect vertically flowing liquid within said vessel into its center, thereby reducing turbulence and splashing; and further having a screen lining the interior perimeter of said vessel to further reduce turbulence by slowing liquid flow before contacting said vessel's side walls.

4. The aquatic exercise and rehabilitation apparatus of claim 2, further comprising an anti-splash treatment vessel of relatively accordion-like configuration having undulating horizontal mantels which serve to redirect vertically flowing liquid within said vessel into its center, thereby reducing turbulence and splashing; and further having a screen lining the interior perimeter of said vessel to further reduce turbulence by slowing liquid flow before contacting said vessel's side walls.

5. The aquatic exercise and rehabilitation apparatus of claim 1, each of said discs having a plurality of transverse receptors, said bridge means being a set of bridge members, each of said bridge members having an end partially disposed within one of said receptors, said crank arms being disposed in said receptors, and the selective mounting of said bridge members and crank arms in selected receptors permitting various lengths of lever and crank arm travel.

6. The aquatic exercise and rehabilitation apparatus of claim 5, wherein said receptors are incrementaly spaced along the radii of said inner and outer discus thereby affording a plurality of locations for the disposition of said bridge members and said crank arms to effect said various lengths of travel.

7. The aquatic exercise and rehabilitation apparatus of claim 1, wherein said frame is comprised of a sleeve member situation below said seat and adapted to slidably receive therein a longitudinally extending box bema which supports said handlebar assembly and said pedal assembly at various distances from said seat to accommodate individuals with a broad range of limb lengths.

8. The aquatic exercise and rehabilitation apparatus of claim 1, wherein at least one of said foot pedals is replaced by a prosthetic limb adaptor having a ring fixedly attached under the arch of said adaptor for the purpose of securing same to said crank arm for use by amputees.

9. The aquatic exercise and rehabilitation apparatus of claim 1, wherein at least one of said foot pedals is replaced by a limb brace adaptor comprised of two U-shaped cradles fixedly mounted to a rigid shaft which terminates in a ring for the purpose of securing said brace to said crank arm for use by those having diminished motor control of one or both lower extremities.

10. The aquatic exercise and rehabilitation apparatus of claim 5, wherein each of said transverse receptors has a cylindrical configuration and wherein said receptors are incrementaly spaced along the radii of said inner and outer discs.

11. The aquatic exercise and rehabilitation apparatus of claim 5, wherein each of said transverse receptors have a radially extending slot configuration.

12. The aquatic exercise and rehabilitation apparatus of claim 1, including a seat belt on said seat.

* * * * *